US005758748A

United States Patent [19]

Barker et al.

[11] Patent Number: 5,758,748

[45] Date of Patent: Jun. 2, 1998

[54] SYNCHRONIZED OFF-SHAFT LOADING OF ELEVATOR CABS

[75] Inventors: Frederick H. Barker, Bristol; Paul Bennett, Waterbury; Anthony Cooney, Unionville; Richard C. McCarthy, Simsbury; Joseph Bittar, Avon; Bruce A. Powell, Canton; Samuel C. Wan, Simsbury; John K. Salmon, deceased, late of South Windsor, all of Conn., by LucyMary Salmon, legal representative

[73] Assignee: Otis Elevator Company, Farmington, Conn.

[21] Appl. No.: 565,606

[22] Filed: Nov. 29, 1995

[51] Int. Cl.[6] ..... B66B 9/16

[52] U.S. Cl. ..... 187/249; 187/414

[58] Field of Search ..... 187/203, 403, 187/414, 392, 393, 249

[56] References Cited

U.S. PATENT DOCUMENTS 1,580,310 4/1926 Lepley .

2,626,721 1/1953 Lodge et al. ..... 214/52

5,090,515 2/1992 Takahashi et al. ..... 187/16

FOREIGN PATENT DOCUMENTS 4-361968 12/1992 Japan .

OTHER PUBLICATIONS

Strackosch, G.R.; "Vertical Transportation: Elevators and Escalators"; pp. 472–475; New York: 1983.

*Primary Examiner*—Boris Milef

[57] ABSTRACT

An elevator cab X is moved from a hoistway TL to a car frame (11) simultaneously with moving a cab Y from the car frame (11) onto a landing TR. Double deck car frames (11*a*) may be utilized with cars P, Q going in the opposite direction of cars X, Y as they are transferred between the car frame and corresponding landings.

10 Claims, 7 Drawing Sheets

SYNCHRONIZED OFF-SHAFT LOADING OF ELEVATOR CABS

TECHNICAL FIELD

This invention relates to simultaneously transferring elevator cabs between landings and elevator car frames, for off-hoistway passenger loading and unloading.

BACKGROUND ART

The sheer weight of the rope in the hoisting system of a conventional elevator limits their practical length of travel. To reach portions of tall buildings which exceed that limitation, it has been common to deliver passengers to sky lobbies, where the passengers walk on foot to other elevators which will take them higher in the building. However, the milling around of passengers is typically disorderly, and disrupts the steady flow of passengers upwardly or downwardly in the building.

All of the passengers for upper floors of a building must travel upwardly through the lower floors of the building. Therefore, as buildings become higher, more and more passengers must travel through the lower floors, requiring that more and more of the building be devoted to elevator hoistways (referred to as the "core" herein). Reduction of the amount of core required to move adequate passengers to the upper reaches of a building requires increases in the effective usage of each elevator hoistway. For instance, the known double deck car doubled the number of passengers which could be moved during peak traffic, thereby reducing the number of required hoistways by nearly half. Suggestions for having multiple cabs moving in hoistways have included double slung systems in which a higher cab moves twice the distance of a lower cab due to a roping ratio, and elevators powered by linear induction motors (LIMs) on the sidewalls of the hoistways, thereby eliminating the need for roping. However, the double slung systems are useless for shuttling passengers to sky lobbies in very tall buildings, and the LIMs are not yet practical, principally because, without a counterweight, motor components and power consumption are prohibitively large.

In order to reach longer distances, an elevator cab may be moved in a first car frame in a first hoistway, from the ground floor up to a transfer floor, moved horizontally into a second elevator car frame in a second hoistway, and moved therein upwardly in the building, and so forth, as disclosed in a commonly owned, copending U.S. patent application Ser. No. 08/564,754, filed contemporaneously herewith, now U.S. Pat. No. 5,657,835. However, loading and unloading of passengers takes considerable time, in contrast with high speed express runs of elevators.

DISCLOSURE OF INVENTION

An object of the invention is to increase the elevator hoistway utilization through the loading and unloading of passengers while the elevator cabs are out of the hoistway, without deteriorating elevator performance.

According to the present invention, an elevator cab is moved horizontally from a landing adjacent to a hoistway onto an elevator car frame in the hoistway simultaneously with moving an elevator cab from said car frame onto a second landing adjacent the hoistway. According to the invention, simultaneous transfer of elevator cabs between car frames and landings permit loading and unloading of passengers while the cabs are out of the hoistway, without reducing the effectiveness of the elevator system. According to the invention still further, the elevator car frames may be double deck frames, and cabs may be simultaneously moved to and from both decks at one time, either in same or opposite directions.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
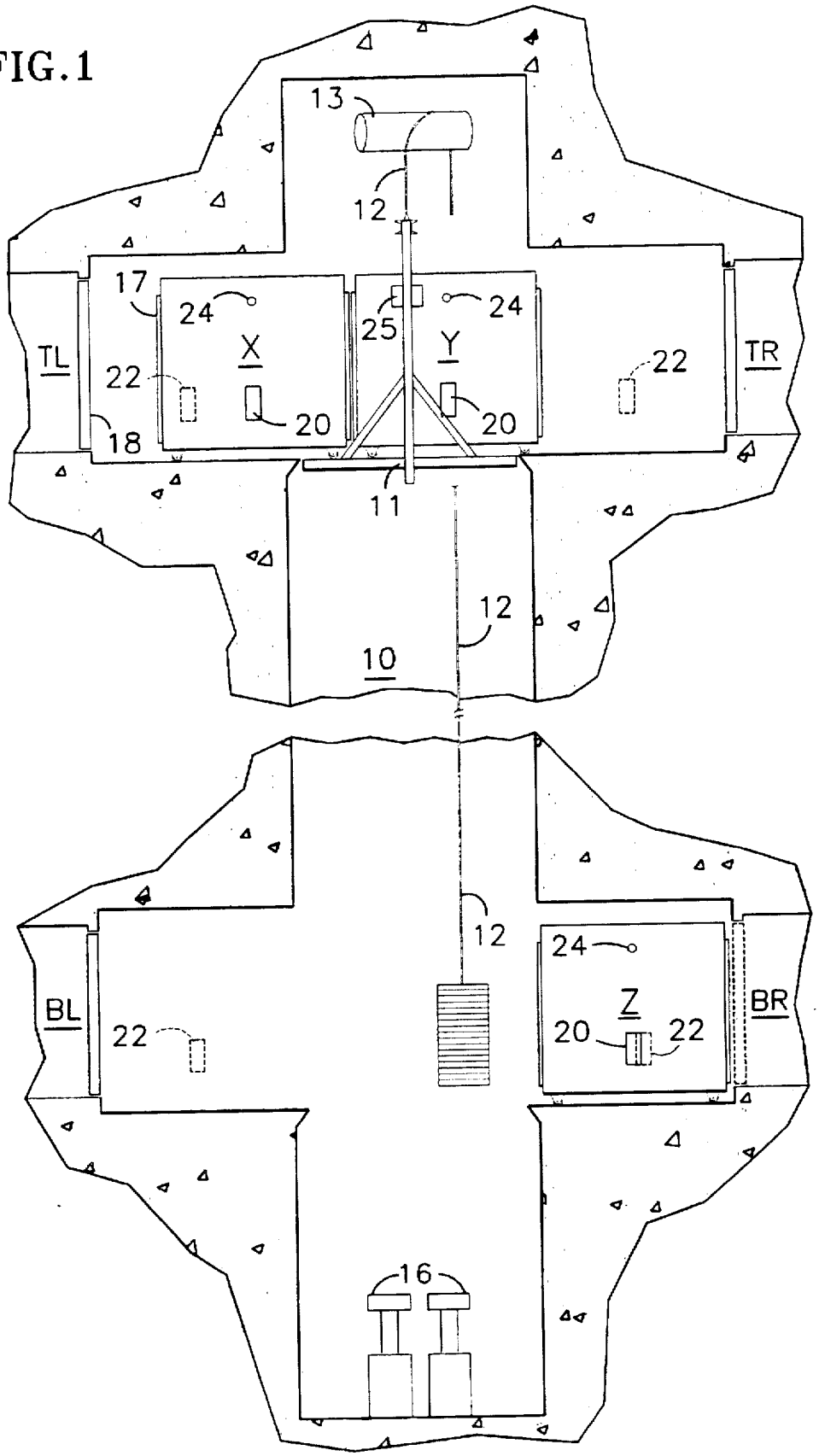
FIG. 1 is a simplified, stylized, partially broken away, partially sectioned side elevation view of a first embodiment of the present invention.

Referring now to FIG. 1, an elevator shuttle in accordance with the present invention includes a hoistway 10, an elevator car frame 11 which is vertically moveable in the hoistway by roping 12 that is controlled by a conventional motor/brake/sheave assembly 13. At the upper end of the hoistway there is a top right landing TR, and a top left landing, TL; at the bottom of the hoistway there is a bottom right landing BR, and a bottom left landing BL. The hoistway 10 may have the usual buffers 16 at the base thereof. A plurality of horizontally moveable cabs are transferrable between the various landings TL, TR, BL, BR and the car frame 11. While the car frame 11 is loading and unloading, it may be locked to the building in the manner described in a commonly owned copending U.S. patent application Ser. No. 08/565,648, filed contemporaneously herewith.

As seen in FIG. 1, a transfer is under way, with the cabs X and Y being horizontally moved concomitantly in concurrence, that is, with the beginning of motion of each being simultaneous with the beginning of motion with the other, and their travel time being concurrent. In a sense, the cabs X, Y, are in lock step with one another; in unison. This is achieved by simultaneously performing a transfer routine on a landing and a car frame in response to a single eject command, as described hereinafter. The image of FIG. 1 will occur when either the cab X is headed for the left landing TL and the cab Y is headed for the car frame 11, or when the cab Y is heading for the landing TR and the cab X is heading for the car frame 11. Assuming the former, in another second or so, the cab X will be firmly placed on the landing TL so that its left car doors 17 will open, and in the usual fashion, also cause the hoistway doors 18 to open. Once the cab X has cleared the car frame 11, and the cab Y is firmly placed thereon, the cabs may or may not be locked into the landing and the car frame, in a manner described in a commonly owned copending U.S. patent application Ser. No. 08/565,658, filed contemporaneously herewith. Then, the roping system 12, 13 will lower the car frame 11 thereby bringing the cab Y into position adjacent the cab Z so that the cabs Y and Z may both be moved to the left, thereby placing the cab Y at the landing BL and the cab Z on the car frame 11. This process can repeat ad infinitum.

In order to enable the controls to keep track of what is happening in the system, each of the cabs X, Y, Z has a position sensing element 20 (shown as a solid rectangle)) which can cooperate with corresponding position sensing elements 22 in each of the four landings (shown as dotted rectangles). The position sensing elements 22 as shown are mounted on the near walls (not shown) of the four landings. As an example, the position sensing elements 20 may simply be switches on either side, one of which would be operated when in a left landing and the other of which would be operated when in a right landing. A similar switch on each of the position sensing elements 22 would determine when there was a cab in the corresponding landing. Furthermore, position sensing within the cab may be accomplished by elements 24, shown as circles in each of the cabs which cooperate with a position sensing element 25 on the car frame which indicates that a cab is properly located on the car frame. Signals from these are utilized as described with respect to FIGS. 4 and 5 hereinafter. The position sensors may comprise proximity detectors, and they may comprise coded sensors, providing a different encoded set of signals depending upon which cab is in which location. All of this is well within the skill of the art and irrelevant to the present invention.

Although not shown herein, each cab is in communication with the building and retains power as it transfers from landing to car frame to landing, in a manner disclosed in commonly owned copending U.S. patent application Ser. No. 08/565,647, filed contemporaneously herewith.

Figure 2:
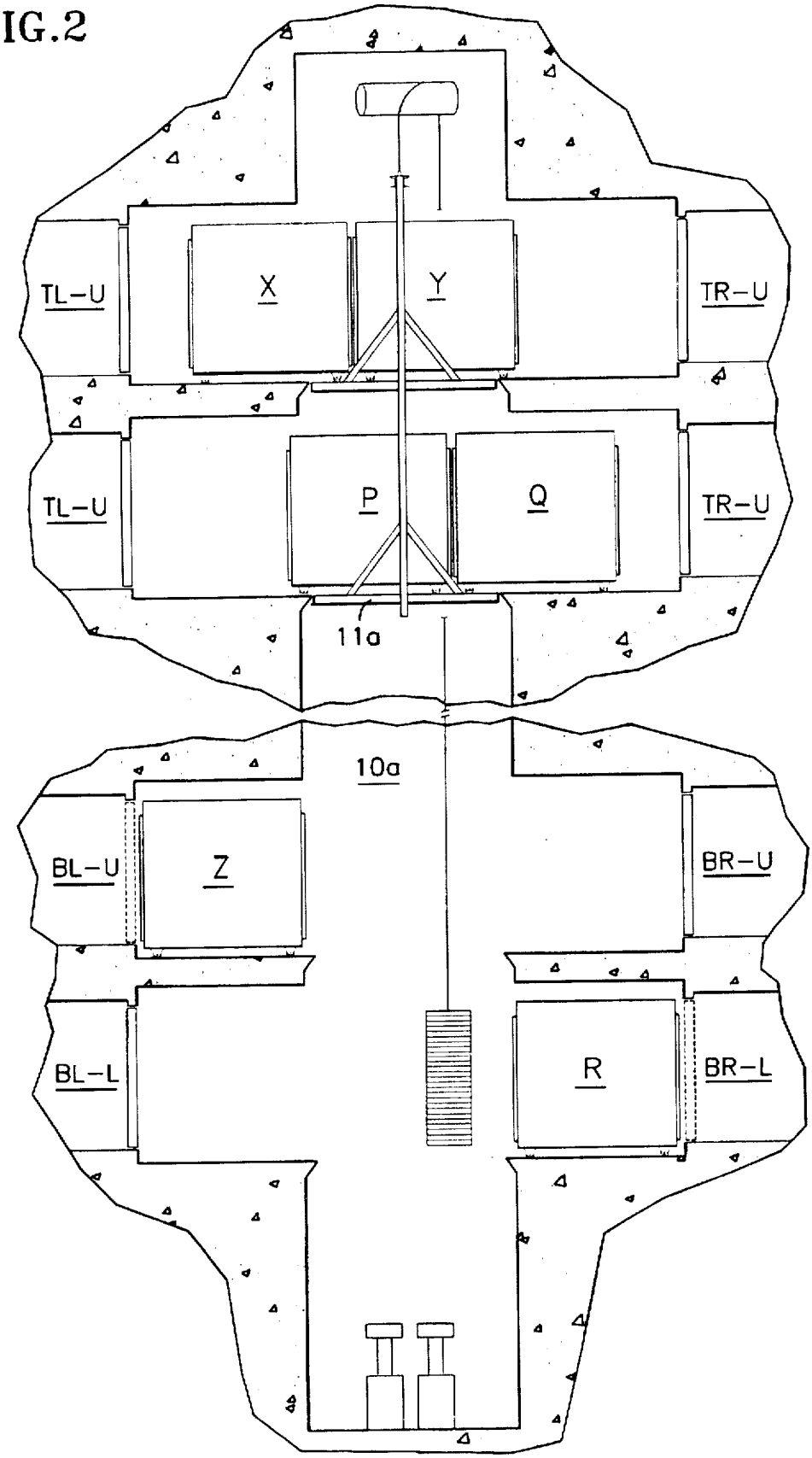
FIG. 2 is a simplified, stylized, partially broken away, partially sectioned side elevation view of a second embodiment of the invention.

The present invention finds its primary value in a shuttle embodiment within a very tall building, wherein the distance between the top and bottom levels of the embodiments herein might be on the order of 3,000 meters. To save core in such a building, eliminating the unloading and loading time at the landings maximizes the actual use of the hoistway for vertical transport. A further enhancement of hoistway usage can be achieved with a multi-decker embodiment, a double decker embodiment being shown in FIG. 2. Therein, the top of the building has four landings, top left—upper and lower; and top right—upper and lower; TL-U, TL-L, TR-U, TR-L, respectively; and there are similarly upper and lower bottom left and bottom right landings, BL-U, BL-L, BR-U, BR-L, at the bottom end of the hoistway 10*a*. The car frame 11*a* has upper and lower decks, as shown. The cabs X, Y and Z are carried on the upper deck of the car frame 11*a* and transfer between the upper decks of the various landings. An additional set of three cabs, P, Q, R are transported on the lower deck of the car frame 11a and moved horizontally between it and the lower decks of the various landings. As shown in FIG. 2, the cabs X, Y are traveling in a direction opposite to the direction of travel of the cabs P and Q, as they are horizontally exchanged between the car frame and the landings. This may generally be preferable, although it is not deemed to be necessary; the cabs could transfer to and from the car frame in the same direction simultaneously on both the upper and lower decks.

Figure 3:
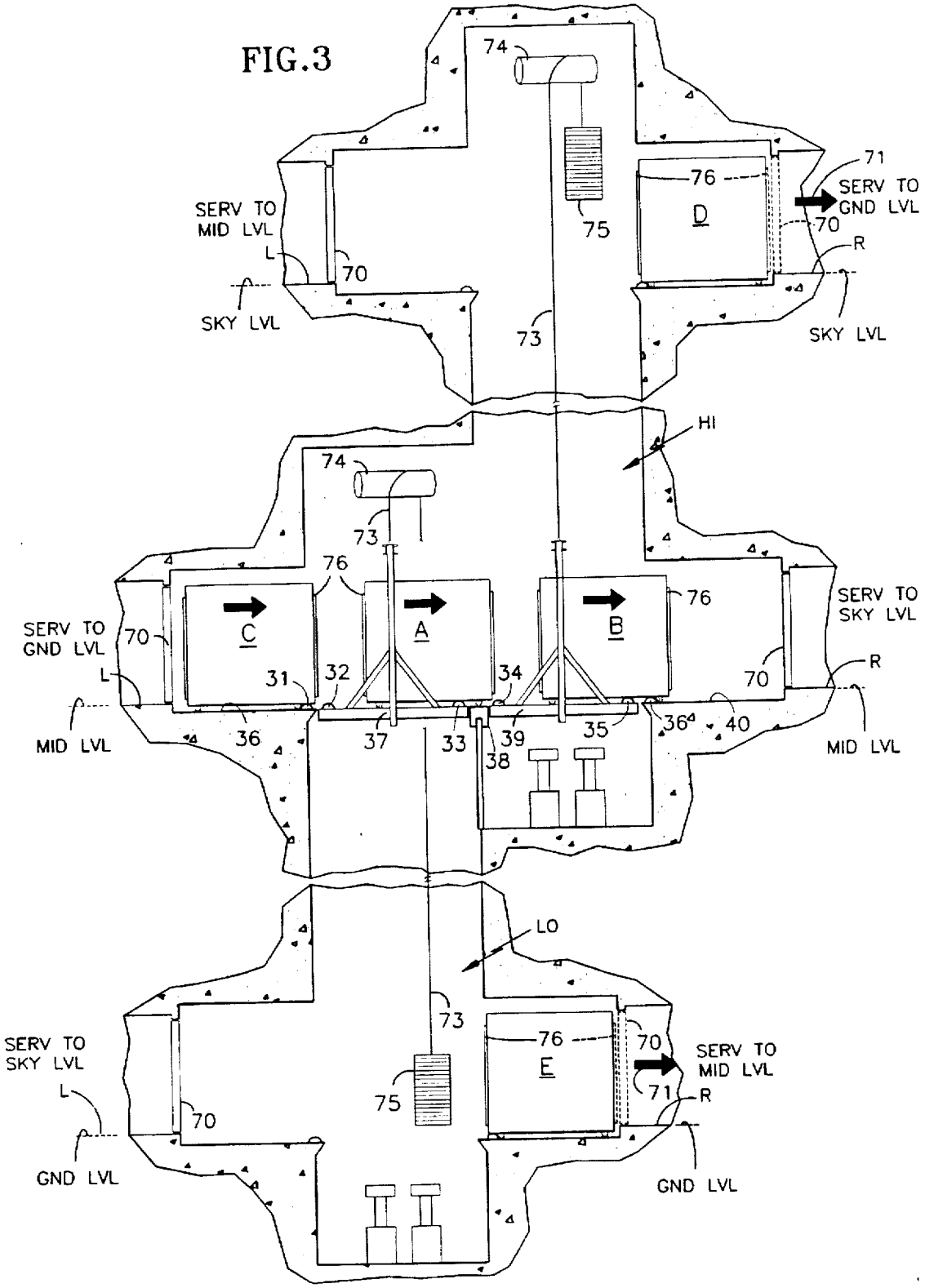
FIG. 3 is a simplified, stylized, partially broken away, partially sectioned side elevation view of a third embodiment of the invention.

Referring to FIG. 3, the invention may also be used in a synchronized shuttle elevator system of a commonly owned copending U.S. patent application Ser. No. 08/564,534, filed contemporaneously herewith, now U.S. Pat. 5,651,426. In FIG. 3, two elevators LO, HI, extend between three levels GND, MID, SKY of a building, each level having a right landing area R and a left landing area L, and having hoistway doors 70, the doors 70 for all of the left landing areas and the mid level right landing area being shown full to indicate that they are closed, and the hoistway doors 70 for the right landing areas of the sky level and the ground level being shown dotted to indicate they are open.

Each elevator LO, HI includes a car having a car frame 72 suspended by a roping system 73 which is driven by a motor, sheave and brake system 74 along with a counterweight 75, in the usual fashion. Hereinafter, for simplicity, the elevator car frames, as well as each entire elevator are referred to by their designations LO, HI, and are referred to simply as cars.

In FIG. 3, there are five elevator cabs A–E, each of which has elevator doors 76 on both the left (L) and right (R) sides. The elevator doors 76 for cabs A–C are shown solid, indicating they are closed. The right elevator doors for cabs D and E are shown dotted to indicate they are open, whereas the left elevator doors for these cabs are shown solid to indicate that they are closed. As in the usual case, when a cab is positioned at a landing, the elevator doors are coupled to the hoistway doors and therefore opening and closing of the elevator cab doors is accompanied by opening and closing of the adjacent hoistway doors; herein, reference to opening or closing of doors means the cab doors and the hoistway doors adjacent the car in question. A pair of arrows 71 indicate that the elevator cab doors and hoistway doors are open at the right landing area of the sky level and ground level.

FIG. 3 depicts cabs D and E at the sky and ground levels, with their doors open, allowing passengers to exchange between the cab and the landing. FIG. 3 also depicts cabs A–C being transferred toward the right: cab C is leaving the mid-level left landing (MID L) and boarding the car frame 37 of the low elevator (LO); cab A is leaving the car frame 39 of the low elevator, crossing a sill 78, and entering onto the car frame 72 of the high elevator (HI); cab B is leaving the car frame 72 of the high elevator (HI) and entering onto the mid-level right landing (MID R). In a few seconds following the time depicted in FIG. 3, cab B will be fully on the MID R landing cab C will be fully disposed on the LO car and cab A will be fully disposed on the HI car. The landings and car frames have motorized pinions 31–36 at each interface across which a cab may be pulled. Thus, assuming that the cabs are moving to the right as shown by the arrows thereon, cab C will have previously been started off the landing 36 by motorized pinion 31 at the same time that cab A was started off the car frame 37 across a sill 38 by motorized pinion 33 at the same time that cab B was started off the car frame 39 by motorized pinion 35. In the present movement to the right, cab B will be pulled onto landing 40 by motorized pinion 36 at the same time that cab A will be pulled onto car frame 39 by motorized pinion 34 at the same time that cab C will be pulled onto car frame 37 by motorized pinion 32. The pinions may also be utilized to pull cabs between landings and a single car frame, as in FIG. 1. It is evident in FIG. 3 that motorized pinions 32, 34 have not yet engaged cabs C and A. Although normally the cabs will be operated in complete synchronism, for the purposes of illustration and clarity, cab B is shown in a position where it has already been engaged by motorized pinion 36. The manner of transferring the cabs between the cars and landings is described with respect to FIG. 6 hereinafter.

Figure 4A:
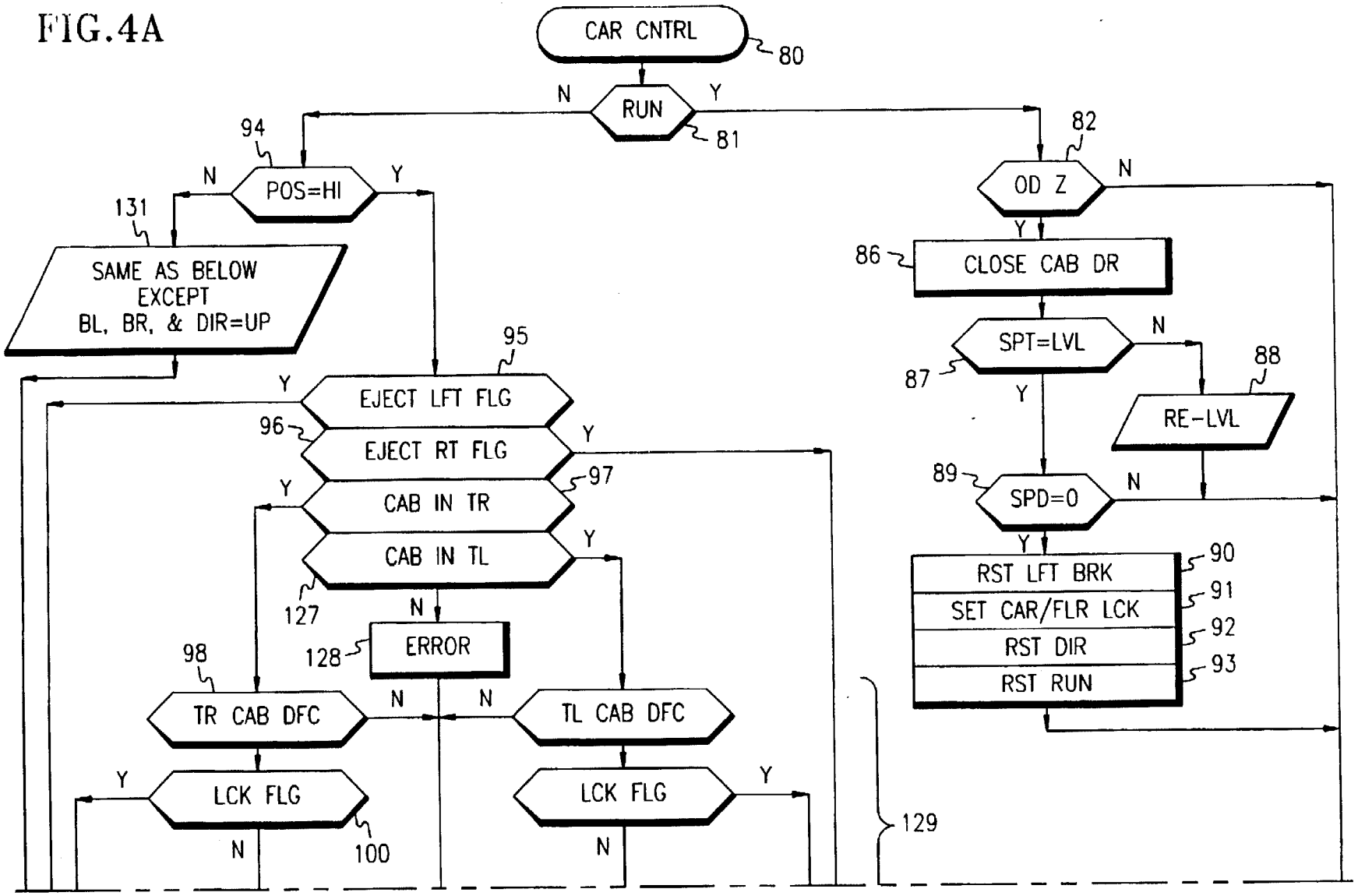
FIG. 4 is a logic flow diagram of an exemplary control routine for use in the invention of FIG. 1.
Figure 4B:
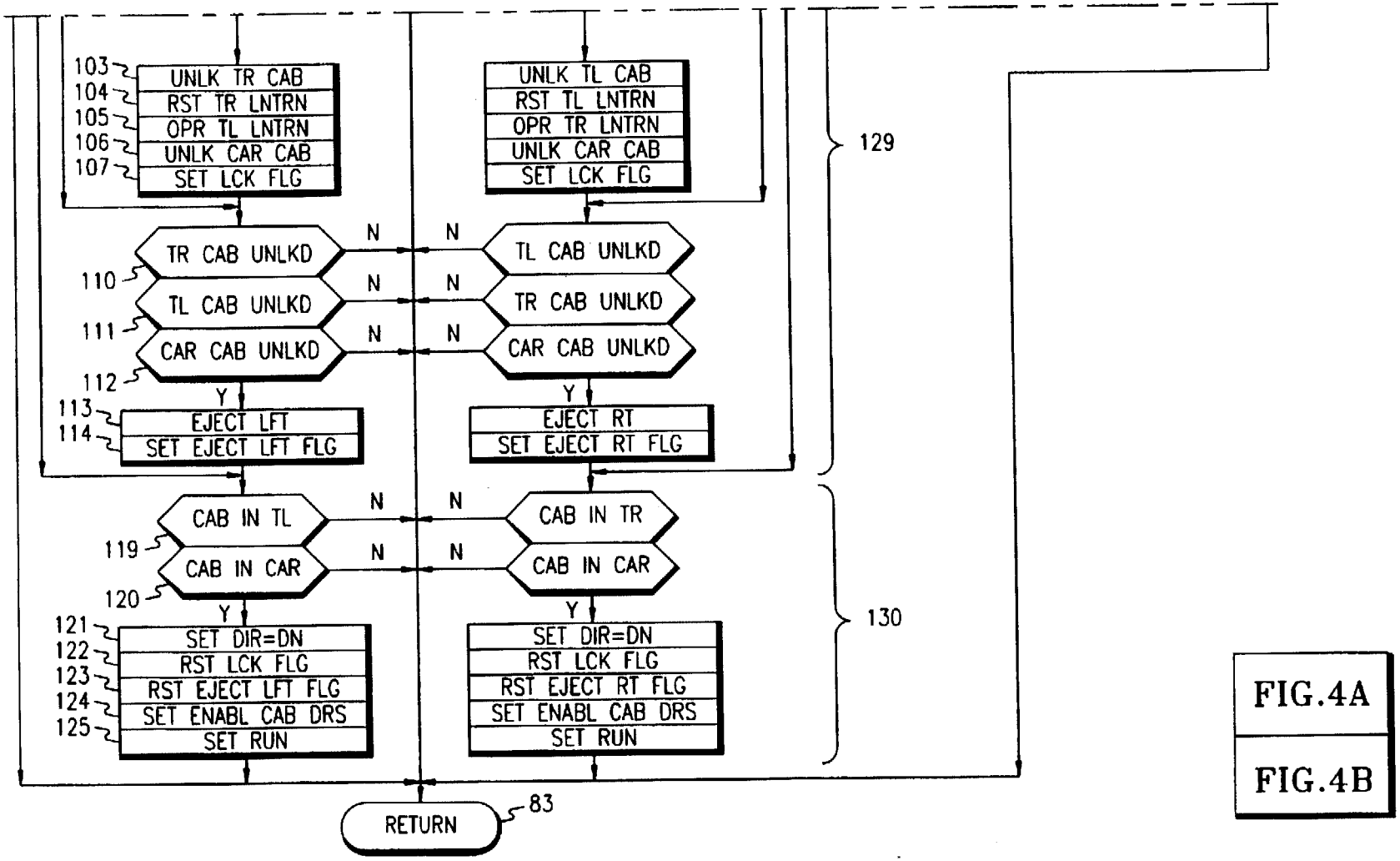

Referring now to FIG. 4, a car control routine is reached through an entry point 80, and a first test 81 determines if the car is running or not. When it is running, an affirmative result of test 81 reaches a test 82 to determine if the car has reached an outer door zone (the point in the hoistway where doors of a normal elevator begin to open). If not, nothing further is accomplished, and other programming is reverted to through a return point 83. This recurs many, many times as the car runs from one of the levels to the other. Eventually, the car frame will be within the outer door zone of one of the landings, and an affirmative result of test 82 will reach a step 86 to close a cab door (as described with respect to FIG. 5 hereinafter). Then a test 87 determines if the secondary position transducer indicates that the cab is level at the landing, or not. If not, a releveling subroutine 88 is reached. In a subsequent pass through the steps and tests 82, 86 and 87, eventually the car frame will be level at the landing so a test 89 determines if the car frame speed is zero. If not, other programming is reached through the return point 83. When the car frame is level and at rest, an affirmative result of test 89 reaches a step 90 to reset the lift brake command, thereby enabling the brake of the roping system to be engaged. A step 91 sets a car floor lock to ensure that the car frame will not move as cabs are transferred between the car frame and the landings. Then a pair of steps 92, 93 reset direction and the run command, thereby officially ending the run.

In the next subsequent pass through the routine of FIG. 4, test 81 will be negative reaching a test 82 to determine if the position of the car is at the high level (as seen in FIG. 1). If it is, a pair of tests 95, 96 determine if flags, indicating cabs being ejected from the car frame have been set or not. Initially, they are not, so a test 97 determines whether there is a cab in the top right landing or not. Assuming that there is a cab in the top right landing, a test 98 determines if its cab doors are fully closed in response to the command of step 86, described further with respect to FIG. 5. If not, nothing further is done and other programming is reached through the return point 83. In a subsequent pass, eventually, test 98 will be affirmative reaching a test 100 to see if a locally used lock flag has been set. Initially, it will not be, so a negative result of test 100 reaches a step 103 to unlock the cab from the top right landing, a step 104 to reset the lantern at the top right landing, a step 105 to operate the lantern at the top left landing, a step 106 to unlock the cab that is in the car frame, and a step 107 to set the lock flag. Since it may take a second or two for the cabs to become unlocked, a series of tests 110–112 determine that the cab in the right landing is unlocked and the cab on the car frame is unlocked, as well as the fact that the cab lock in the left landing is in the unlocked position so that it can receive a cab. So long any of these are not unlocked, negative results of one of the tests 110–112 will cause other programming to be reached through the return point 83. When all three locks are unlocked, an affirmative result of test 112 reaches a step 113 to eject toward the left, which will cause cab X of FIG. 1 to proceed toward the TL landing and cab Y to proceed from the TR landing toward the car frame, by simultaneously operating pinions on the landing TL and on the car frame 11, such as by means of a transfer routine of the type illustrated in FIG. 9 of a commonly owned copending U.S. patent application Ser. No. 08/564,704 filed Nov. 29, 1995. Then a step 114 sets the eject left flag.

In subsequent passes, test 81 is negative, test 82 is positive and now test 95 will be positive, causing the program to advance to a pair of tests 119–120 which determine when the transfer of two cars to the left has been completed as indicated by signals indicating that a cab is in the top left landing and a cab is in the car frame. While the cabs are being transferred, the eject flag of test 95 causes the program to go into limbo until both of the tests 119, 120 are affirmative. And during that time, other programming is reached through the return point 83. When both of the cabs are in place, affirmative results of tests 119 and 120 reach a step 121 to set the car frame direction to down, a step 122 to reset the lock flag, a step 123 to reset the eject left flag, and a step 124 to set the run command for the car. And then other programming is reverted to through the return point 83.

If the cab had not been in the top right landing, test 97 would have been negative, reaching a test 127 to see if a cab was in the top left landing. If not, a negative result of test 127 would reach a step 128 to set an error indication and other programming would be reached through the return point 83. On the other hand, if test 127 were affirmative, then a plurality of steps and tests 129 would be reached, which are equivalent in all respects to the steps and tests 98–114 described hereinbefore. And, once an eject right flag had been set so that an affirmative result of test 96 is achieved, then a series of tests and steps 130 equivalent to tests and steps 119–124 would be reached.

In the event that the position of the car was not at the high end of the shaft, so that test 82 was negative, then a subroutine 131 would be reached which would perform steps and tests for the car and relating to the landings at the low end of the shaft BL, BR and set the direction of the car to up, in a fashion fully commensurate with that described with respect to the high end of the shaft in steps and tests 95–130 hereinbefore.

Figure 5:
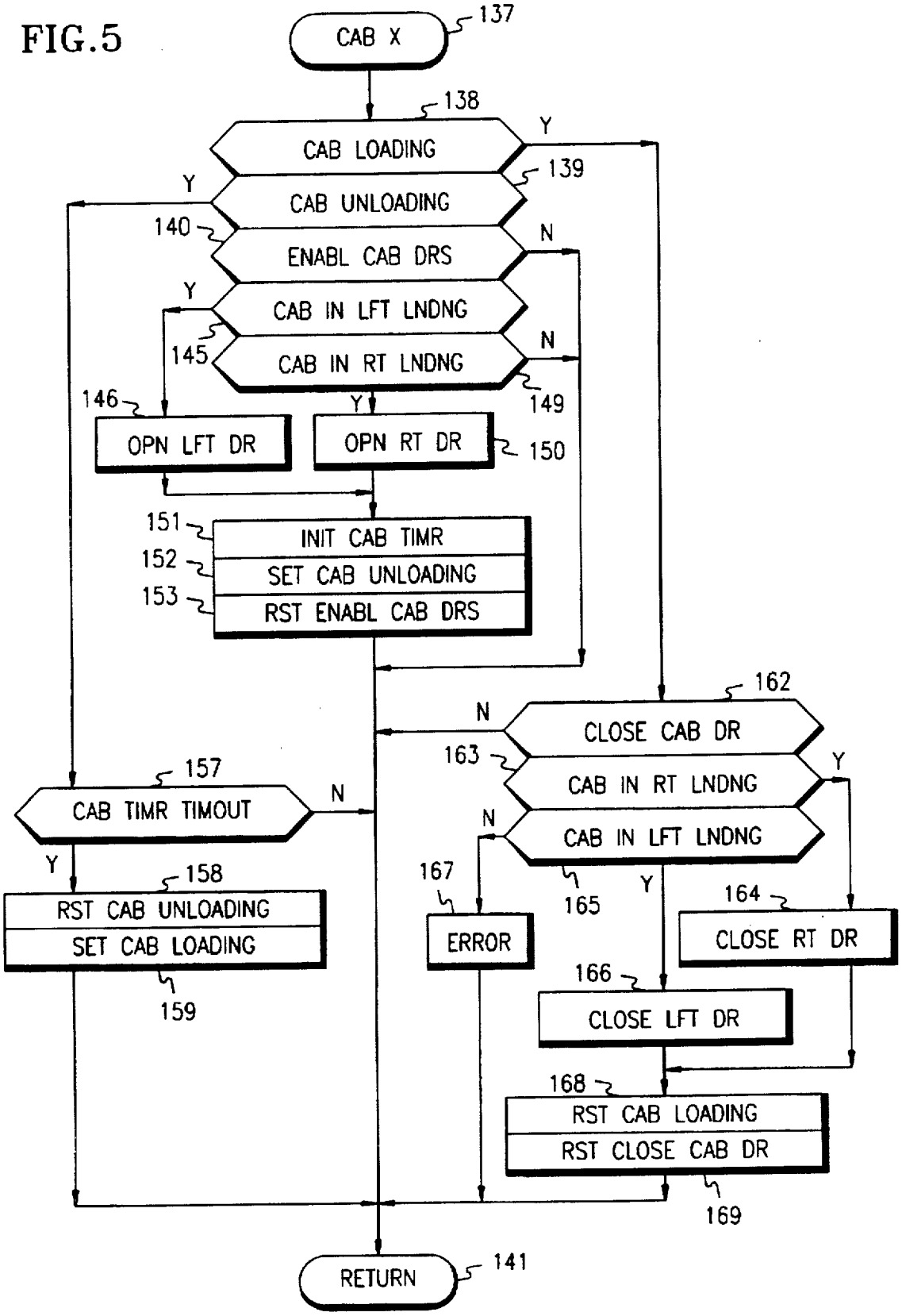
FIG. 5 is a logic flow diagram of an exemplary cab control routine for use in the invention of FIG. 1.

Referring now to FIG. 5, a routine for controlling the doors in cab X (which is identical to that for cabs Y and Z) is reached through an entry point 137, and a first test 138 determines if a local cab loading flag has been set yet or not. If it is assumed that cab X has just reached the left landing, the cab loading flag will not have been set so a negative result reaches a test 139 to see if a cab unloading flag has been set yet, or not. When the cab is initially in a landing, it will not have been set, so a negative result of test 139 reaches a test 140 to see if the car control of FIG. 4 has sensed that a cab is in place (test 119) and has set the enable cab doors flag in step 124. Initially, it may not, so a negative result of test 140 will cause other programming to be reverted to through a return point 141. In a subsequent pass through the routine of FIG. 5, eventually, the set enable cab doors step will have been reached in FIG. 4 so an affirmative result of test 140 will reach a test 145 to determine if the cab is in the left landing, as has been assumed. An affirmative result of test 145 reaches a step 146 to open the left door of cab X. On the other hand, if test 145 is negative, a test 149 determines if the cab is in a right landing. If it is, a step 150 will open the right door of the cab. However, if the cab is not in a landing, but rather is either in the car frame or being horizontally moved between a car frame and the landing, negative results of both tests 145 and 149 will cause other programming to be reached through the return point 141, with no door action at all. This routine through the routine of FIG. 5 will be taken much of the time whenever the cab is in vertical or horizontal motion.

Assuming the cab is in a landing, after opening either of the doors at steps 146 and 150, a step 151 initiates a cab timer, a step 152 sets a cab unloading flag, and a step 153 resets the enable cab doors flag which is set by the car control in step 124 (and similar steps). The cab unloading flag of step 152 defines a period of time when the cab should ignore operations of the car frame and commands from the car controller since it will be sitting at the landing allowing passengers to unload and then allowing passengers to load. The cab timer has a time out on the order of one and one-half transit times for the car frame so that as soon as the cab is deposited at a landing, it will ignore commands from the car once its doors are open until the car frame travels to the opposite end of the hoistway and most of the way back. This is necessary in this embodiment since the cab does not know where it is or where the car is, other than that the cab is at a landing. The cab timer avoids having cab X respond when the car frame reaches the lower landing and is attempting to cause cab Z to respond.

After the steps 151–153, other programming is reached through the return point 141. In the next pass through the routine of FIG. 5, test 138 is negative but now test 139 is affirmative reaching a test 157 to determine if the cab timer has timed out, or not. For many passes through the routine, a negative result of test 157 will reach the return point 141. After a period of time which is on the order of the time it takes for the car frame to traverse the entire hoistway and half-way back or so, in a subsequent pass through the routine of FIG. 5, the timer will time out so an affirmative result of test 157 reaches a step 158 to reset the cab unloading flag, and a step 159 to set a cab loading flag. This defines a period of time when the cab once again becomes responsive to the fact that the car frame is going to come to its level and pick it up again.

In the next pass through the routine of FIG. 5, test 138 is affirmative reaching a test 162 to determine if the car control has sensed that the car is approaching a landing for many passes through the routine of FIG. 5, test 161 will be negative, bypassing the rest of the routine and reaching other programming through the return point 141. Eventually, when the car frame reaches the outer door zone, step 86 of FIG. 4 will be reached, and the next pass through the routine of FIG. 5 will have an affirmative result of test 162. This reaches a test 163 to determine if the car is in a right landing. If so, a step 164 will close the right door of the cab. But in the assumption, the cab is in a left landing so a negative result of test 163 reaches a test 165 which will be affirmative, thereby causing a step 166 to close the left door. If tests 163 and 165 indicate that the cab is not in either landing, then a negative result of test 165 will set an error in a step 167. After the cab door is ordered to be closed, a pair of steps 168, 169 will reset the cab loading flag of cab X and will reset the close cab door flag set in step 86 of FIG. 4.

Thus, the car control will tell all of the cabs to open the door or to close the door, and the one cab which is postured to respond appropriately to a door opening or a door closing will do so, and then reset the command in the car control routine.

The invention may also be practiced utilizing a repetitive cycle timer, in a manner which is described in great detail in the aforementioned copending application Ser. No. 08/564,534 now U.S. Pat. No. 5,651,426. The embodiment of FIG. 2 may be practiced with an obvious extension of FIG. 4 which would replicate the steps and tests 94–131 for the lower deck, and additional versions of the routine of FIG. 5 for the additional cabs. Or, the embodiment of FIG. 2 may be controlled by a cyclic timer as in the aforementioned application Ser. No. 08/564,534. The invention is shown in roped elevator embodiments; it may be employed in linear induction motor embodiments, as well.

The best mode for transferring a cab between cars might be that disclosed in said application Ser. No. 08,564,704, described briefly with respect to FIG. 6 herein. Only one cab is shown for clarity even though in this invention, a plurality of cabs are moved simultaneously by each responding to an "eject right" or "eject left" command.

Figure 6:
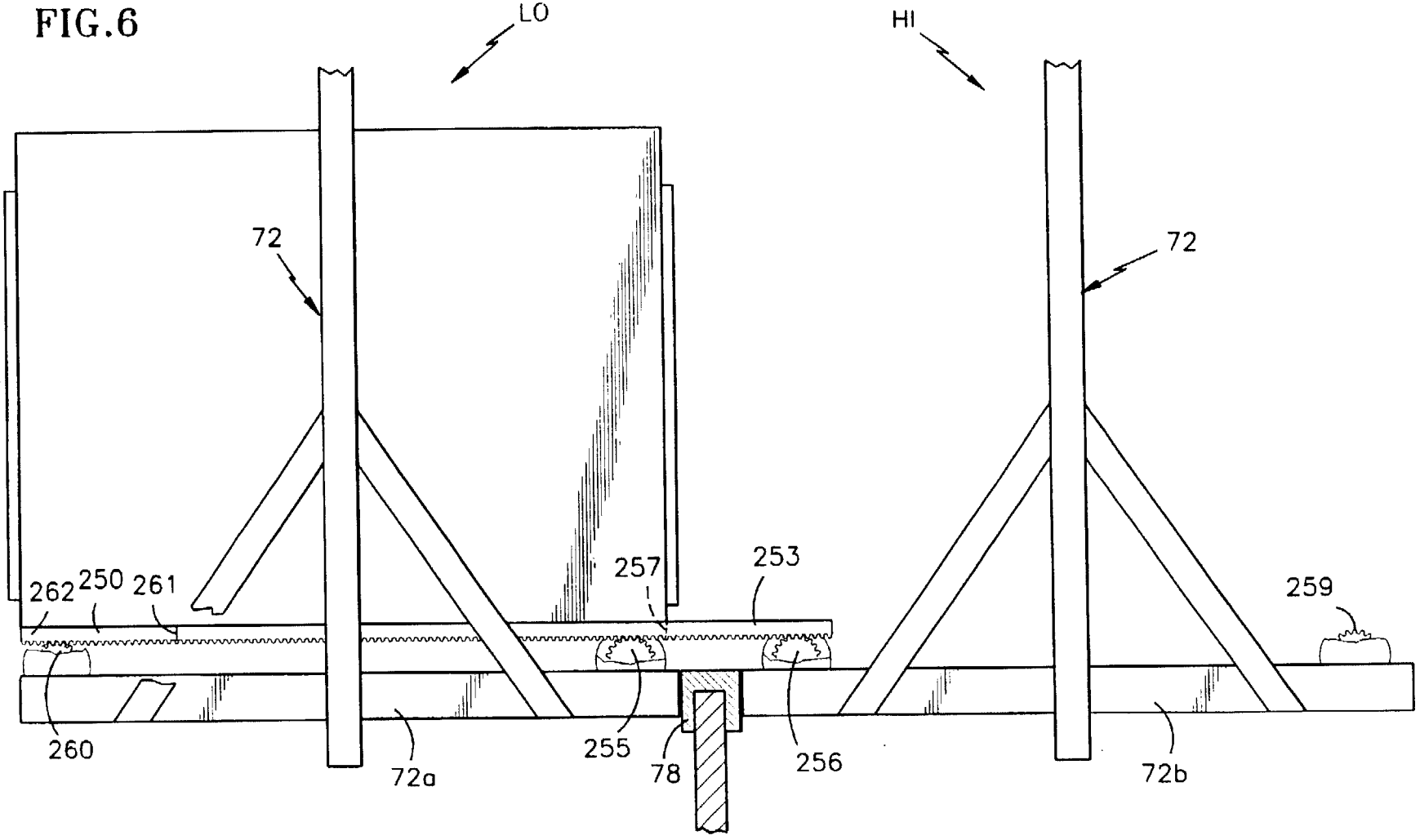
FIG. 6 is a simplified illustration of horizontal motive means for moving cabs horizontally.

In FIG. 6, the bottom of the cab A has a fixed, main rack 250 extending from front to back (right to left in FIG. 6), and a sliding rack 253 that can slide outwardly to the right, as shown, or to the left. There are a total of four motorized pinions on each of the car frame platforms **72*a*, 72*b*. First, an auxiliary motorized pinion 255 turns clockwise to drive the sliding auxiliary rack 253 out from under the cab into the position shown, where it can engage an auxiliary motorized pinion 256 on the platform 72*b*, which is the limit that the rack 253 can slide. Then, the auxiliary motorized pinion 256 will turn clockwise pulling the auxiliary rack 253 (which now is extended to its limit) and therefore the entire cab A to the right as seen in FIG. 6 until such time as an end 257 of the main rack 250 engages a main motorized pinion (not shown) which is located just behind the auxiliary motorized pinion 256 in FIG. 6. Then, that main motorized pinion will pull the entire cab A fully onto the platform 72*b* by means of the main rack 250, and as it does so a spring causes the slidable auxiliary rack 253 to retract under the cab A. An auxiliary motorized pinion 259 can assist in moving the cab A to the right to another car frame or landing (such as MID R). Similarly, an auxiliary pinion 260 can assist in moving a cab (such as cab C) from a landing (MID L) to the left of that shown in FIG. 6 onto the platform 72*a***.

To return the cab A from the platform **72*b* to the platform 72*a*, the auxiliary pinion 256 will operate counterclockwise, causing the sliding, auxiliary rack 253 to move outwardly to the left until its left end 261 engages the auxiliary pinion 255. Then the auxiliary pinion 255 pulls the auxiliary rack 253 and the entire cab A to the left until the left end 262 of the main rack engages a main motorized pinion (not shown) located behind the auxiliary motorized pinion 255, which then pulls the entire cab A to the left until it is fully on the frame 72*a***.

All of the aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A structure having a synchronized elevator shuttle, comprising:

a building having a plurality of mutually-separated lobby levels, with two passenger landings on opposite sides of a hoistway on each lobby level;

an elevator having a car frame vertically movable in the hoistway, extending between two of said levels;

a plurality of elevator cabs, each movable between said car frame and said landings; and means for moving one of said cabs from a first one of said landings on a first lobby level to the car frame in said hoistway simultaneously with moving a second cab from said car frame to a second landing on said first lobby level, and for alternatively, moving at least one of said cabs from said car frame to a third landing on a second lobby level simultaneously with moving a third cab from a fourth landing on said second lobby level onto said car frame.

2. A method of moving passengers from a first landing on a first floor of a building along an elevator hoistway in said building to a second landing on a second floor of said building, comprising the steps of:

(a) loading passengers into a first cab at said first landing;

(b) moving said cab from said first landing to a car frame in said hoistway simultaneously with moving a second cab from said car frame to a third landing on said first floor;

(c) moving said first cab from said first floor to said second floor on said car frame;

(d) at said second floor, moving said first cab from said car frame to said second landing simultaneously with moving a third cab from a fourth landing on said second floor onto said car frame; and (e) unloading passengers from said first cab on said second landing.

3. A method of moving passengers between two passenger lobby floors of a building, comprising:

providing an elevator having an elevator car movable between two terminal levels in a hoistway, a lower one of said terminal levels being a lower passenger lobby floor and an upper one of said terminal levels being an upper passenger lobby floor, and a plurality of cabs which may be moved horizontally between landings on each said floor and said car;

loading passengers from said lower lobby floor into a first cab of said plurality of cabs at a first landing on said lower terminal level;

then moving said first cab from said first landing onto said elevator car while simultaneously moving a second cab of said plurality of cabs from said elevator car to a second landing on said lower terminal level;

then moving said first elevator car to said upper terminal level;

then moving said first cab from said elevator car to a third landing on said upper terminal level while simultaneously moving a third cab to said car from a fourth landing on said second terminal level; and then discharging passengers from said first cab at said upper lobby floor.

4. A structuring having a synchronized elevator shuttle, comprising:

a building having a plurality of mutually-separated lobby levels, with two passenger landings on opposite sides of a hoistway on each lobby level;

an elevator having a car vertically movable in the hoistway, extending between two of said levels;

a plurality of elevator cabs, each movable between said elevator car and said landings; and means for, alternatively— moving one of said cabs in a first horizontal direction onto a first one of said landings from said car while simultaneously moving another one of said cabs in said first horizontal direction onto said car from a second one of said landings, or moving one of said cabs in a second horizontal direction onto said car from said first landing while simultaneously moving another one of said cabs in said second horizontal direction onto said second landing from said car, or moving one of said cabs in said first horizontal direction onto a third one of said landings from said car while simultaneously moving another one of said cabs in said first horizontal direction onto said car from a fourth one of said landings, or moving one of said cabs in said second horizontal direction onto said fourth landing from said car while simultaneously moving another one of said cabs in said second horizontal direction onto said car from said third landing.

5. A structure shuttle according to claim 4 wherein:

said car is a double deck car, for holding one cab above another cab;

said building includes two upper deck landings and two lower deck landings related to each building level, each upper deck landing above a corresponding lower deck landing; and said means for alternatively moving comprises:

moving a first one of said cabs in a first horizontal direction onto a first one of said lower deck landings on a first one of said levels from the lower deck of said car, while simultaneously moving a second one of said cabs in said first horizontal direction onto the lower deck of said car from a second one of said lower deck landings on said first level, while simultaneously moving a third one of said cabs in one of said horizontal directions onto the upper deck of said car from one of said upper deck landings on said first level, and while simultaneously moving a fourth one of said cabs in said one horizontal direction onto the other of said upper deck landings on said first level from the upper deck of said car, or moving a first one of said cabs in a first horizontal direction onto the lower deck of said first car from a third lower deck landing on a second one of said levels, while simultaneously moving a second one of said cabs in said first horizontal direction onto a fourth lower deck landing on said second level from the lower deck of said car, while simultaneously moving a third one of said cabs in one of said horizontal directions onto a third upper deck landing on said second level from the upper deck of said car while simultaneously moving a fourth one of said cabs in said one horizontal direction onto the upper deck of said car from a fourth upper deck landing on said second level.

6. A method of operating an elevator shuttle having an elevator car frame moveable within a hoistway between a plurality of levels of a building and a plurality of elevator cabs that are moveable onto and off of said car frame, comprising:

(a) loading and unloading passengers to and from elevator cabs that are out of the elevator hoistway at floor landings;

(b) horizontally moving a plurality of said cabs in unison to transfer cabs from said landings onto said car frame in said hoistway and to simultaneously transfer cabs to said landings from said car frame; and (c) moving said car frame in said hoistway between said levels.

7. A method according to claim 6 wherein:

said building includes a pair of floor landings at each level, each on an opposite side of said hoistway from the other.

8. A method according to claim 6 wherein said elevator car frame is a double deck frame and said landings include upper and lower landings corresponding to the decks of said frame at each level, and said step (b) comprises moving a first cab from a first lower landing to the lower deck of said car frame simultaneously with moving a second cab from the upper deck of said car frame to an upper landing on the same building level as said first lower landing.

9. A method according to claim 6 wherein said elevator car frame is a double deck car frame and said landings include upper and lower landings corresponding to the decks of said frame at each level, and said step (b) comprises moving a first cab from a first lower landing at a first level to the lower deck of said frame simultaneously with moving a second cab from the upper deck of said frame to an upper landing above said first lower landing, simultaneously with transferring a third cab to a second lower landing at said first level from the lower deck of said frame, simultaneously with transferring a fourth cab to the upper deck of said frame from an upper landing above said second lower landing.

10. A structure having a synchronized elevator shuttle, comprising:

a building having a plurality of mutually-separated lobby levels, with two passenger landings on opposite sides of a hoistway on each lobby level;

an elevator having a car frame vertically movable in the hoistway, extending between two of said levels;

a plurality of elevator cabs, each movable between said car frame and said landings; and means for directly engaging and moving one of said cabs from a first one of said landings on a first lobby level to the car frame in said hoistway simultaneously with directly engaging and moving a second cab from said car frame to a second landing on said first lobby level, and for alternatively, directly engaging and moving at least one of said cabs from said car frame to a third landing on a second lobby level simultaneously with directly engaging and moving a third cab from a fourth landing on said second lobby level onto said car frame.

* * * * *